US006419312B1

(12) United States Patent
Flannery et al.

(10) Patent No.: US 6,419,312 B1
(45) Date of Patent: Jul. 16, 2002

(54) INCREMENTALLY SLIDABLE HIGH CHAIR TRAY WITH QUICK RELEASE

(75) Inventors: Mark A. Flannery, Shorewood; Timothy L. Edwards, Minneapolis, both of MN (US); Danial E. Julian, Berthoud, CO (US)

(73) Assignee: Regalo International, LLC, Plymouth, MN (US)

( * ) Notice: Subject to any disclaimer, the term of this patent is extended or adjusted under 35 U.S.C. 154(b) by 0 days.

(21) Appl. No.: 09/698,748

(22) Filed: Oct. 27, 2000

(51) Int. Cl.[7] ..... A47B 83/02

(52) U.S. Cl. ..... 297/149; 297/148; 297/151; 297/153

(58) Field of Search ..... 297/149, 148, 297/151, 153

(56) References Cited

U.S. PATENT DOCUMENTS

| | | | | | |
|---|---|---|---|---|---|
| 1,182,938 | A | | 5/1916 | Snideman | |
| 1,361,505 | A | | 12/1920 | Snideman | |
| 1,983,138 | A | * | 12/1934 | Lehman | 297/149 |
| 2,115,860 | A | * | 5/1938 | Kroll et al. | 297/151 |
| D137,442 | S | | 3/1944 | Nordby | |
| D148,187 | S | | 12/1947 | Renaud | |
| 2,505,490 | A | * | 4/1950 | Greenbaum | 297/151 |
| 2,728,378 | A | * | 12/1955 | Hamilton | 297/151 |
| 3,146,738 | A | | 9/1964 | Telarico | |
| 4,105,247 | A | * | 8/1978 | Saint | 297/149 |
| 4,723,813 | A | * | 2/1988 | Kassai | 297/149 X |
| 4,807,928 | A | * | 2/1989 | Cone | 297/151 X |
| 4,968,092 | A | * | 11/1990 | Giambrone | 297/151 |
| 5,238,292 | A | * | 8/1993 | Golenz et al. | 297/149 X |
| 5,348,374 | A | * | 9/1994 | Kuo | 297/153 X |
| D356,689 | S | | 3/1995 | Mariol | |
| D358,730 | S | | 5/1995 | Meeker et al. | |
| 5,489,138 | A | * | 2/1996 | Mariol et al. | 297/151 |
| 5,507,550 | A | * | 4/1996 | Maloney | 297/149 X |
| 5,527,090 | A | * | 6/1996 | Cone, II | 297/149 |
| 5,558,400 | A | * | 9/1996 | Poulson et al. | 297/153 X |
| 5,810,432 | A | * | 9/1998 | Haut et al. | 297/153 |
| 5,823,615 | A | * | 10/1998 | Haut | 297/151 |
| D409,026 | S | | 5/1999 | Rosko et al. | |
| 5,951,102 | A | * | 9/1999 | Poulson et al. | 297/153 X |
| 5,992,932 | A | * | 11/1999 | Kain et al. | 297/151 X |
| D419,311 | S | | 1/2000 | Maggeni et al. | |
| 6,024,412 | A | * | 2/2000 | Kin et al. | 297/149 X |
| D426,965 | S | | 6/2000 | Wu | |
| D427,462 | S | | 7/2000 | Boney | |
| D427,822 | S | | 7/2000 | Greger | |
| D428,715 | S | | 8/2000 | Brevi | |
| 6,126,236 | A | | 10/2000 | Wu | 297/148 X |

FOREIGN PATENT DOCUMENTS

| | | | | |
|---|---|---|---|---|
| FR | 1278364 | * | 10/1961 | 297/149 |

* cited by examiner

*Primary Examiner*—Peter M. Cuomo
*Assistant Examiner*—Rodney B. White

(57) ABSTRACT

A tray apparatus for a high chair wherein the tray apparatus includes a tray that is incrementally slideable to a multiple number of positions. The sliding is controlled by a hand operated knob disposed on an outer edge of the tray, a location of convenience for the caregiver. The inner sliding mechanism includes a hand operated screw having threads that engage a thread receptor in a base on which the tray slides. The tray and base are further engaged via guide portions that frictionally engage each other to minimize a free sliding of the tray and base relative to each other and maximize a controlled sliding, via the hand operated screw, of the base and tray relative to each other. The guide portions guide the sliding of the base and tray relative to each other and further lock the tray and base relative to each other. The tray and base are unlocked relative to each other by resiliently drawing one of the guide portions away from the other of the guide portions.

16 Claims, 9 Drawing Sheets

38
12
116
118
38
10
118
32
22
20
174
22
60
36
16
14
40
18
24
30
26
28

INCREMENTALLY SLIDABLE HIGH CHAIR TRAY WITH QUICK RELEASE

BACKGROUND OF THE INVENTION

The present invention relates to trays that are slideable to a number of positions relative to a high chair, to trays that have hand operated screws to slide the tray back and forth relative to the high chair, and to trays that have a single release handle to disconnect the tray relative to the high chair.

Infants grow into toddlers and toddlers soon insist on sitting at the table, not in a high chair. However, during the growth process when the high chair is necessary, infants and toddlers grow in breadth as well as in height. This requires an adjustment of the tray relative to the seat of the high chair.

Of course, adjustment of the tray relative to the seat of the high chair occurs for other reasons. At breakfast a toddler may like his cup close to him. At lunch on the same day the toddler may like his cup far away. Or, if chicken noodle soup is served, it may be beneficial for the father to have the tray fitting snugly up against the chest of the toddler.

A typical high chair includes a tube or a pair of tubes as a base for a tray. The tubes have holes punched therein at a three or four positions. Pins may engage the holes to set the tray at a certain position. Accordingly, on the day chicken noodle soup is served, the tray may fit too tightly or too loosely against the chest of a toddler. Further, the mechanism that controls the engagement of the pins in the holes is often difficult to operate such that, during adjustment of the tray, the tray may be jarred and the chicken noodle soup may be spilled.

SUMMARY OF THE INVENTION

A feature of the present invention is the provision in a high chair having a tray, of a hand operated screw mechanism for sliding the tray to and from the seat of the high chair.

Another feature of the present invention is the provision in a high chair having a tray, of a base for the tray, wherein the base is engageable to the high chair and wherein the tray is engageable to the base in a sliding manner.

Another feature of the present invention is the provision in a high chair having a tray slideable to and from a seat of the high chair, of a control knob for operating the sliding of the tray, and wherein the control knob is on an outer edge of the tray, away from the toddler sitting in the seat and close to the parent feeding the child.

Another feature of the present invention is the provision in a high chair having a tray, of an engagement mechanism between the tray and the high chair or between the tray and a base for the high chair, wherein the engagement mechanism is a quick release mechanism for quick engagement and quick disengagement of the tray relative to the base.

Another feature of the present invention is the provision in a high chair having a tray, of an engagement mechanism between the tray and the high chair or between the tray and a base for the high chair, wherein the engagement mechanism includes a guide portion on the tray and a cooperating guide portion on the base or on the high chair, and wherein the guide portions provide a degree of friction to a sliding action of the tray relative to the base or to the tray relative to the high chair such that sliding action is controllable.

Another feature of the present invention is the provision in a high chair having a tray, of an engagement mechanism between the tray and the high chair or between the tray and a base for the high chair, wherein the engagement mechanism includes a guide portion on the tray and a cooperating guide portion on the base or on the high chair, and wherein one of the guide portions is resiliently biased toward the other of the guide portions so as to normally lock the guide portions together such that the base and tray or tray and high chair are normally locked together.

Another feature of the present invention is the provision in a high chair having a tray, of an engagement mechanism between the tray and the high chair or between the tray and a base for the high chair, wherein the engagement mechanism includes a release handle that is operated with one hand.

Another feature of the present invention is the provision in a high chair having a tray, of an engagement mechanism between the tray and the high chair or between the tray and a base for the high chair, wherein the engagement mechanism engages the base or high chair at a first location and is operated via a release handle at a second location, wherein the second location is located at an outer edge of the tray away from the toddler and close to the caregiver, and wherein a pulley system is employed between the first and second locations.

Another feature of the present invention is the provision in a high chair having a tray and further having a seat that is incrementally adjustable in height, of a tray that is engaged to the seat and incrementally adjustable to and away from the seat such that the tray is both incrementally adjustable vertically and horizontally.

Another feature of the present invention is the provision in a high chair having a tray, of the tray being engageable to a base on the high chair and with the base also taking the form of a tray such that, when the tray is being cleaned, the base may serve as a substitute tray.

An advantage of the invention is that the tray is infinitely adjustable. A ruler may have a fixed length. However, there are an infinite number of positions within that twelve inches. For example, there is a position at five and ½ inch, another position at five and ¼ inch, still another position at five and ⅛ inch, yet another position at five and 1/16 inch, and yet other positions at five and 1/32 inches, five and 1/64 inches, five and 1/128 inches, and ad infinitem. Accordingly, there are an infinite number of positions within the twelve inches of a ruler. Likewise, the mechanism that permits a sliding of the tray relative to the seat of the high chair is infinitely adjustable to a multiple number of positions. One size fits all.

Another advantage of the invention is that operation of the infinitely adjustable slide mechanism is smooth. The hand operated screw may be operated without spilling chicken noodle soup that is filled to the brim in a bowl located on the tray.

Another advantage of the invention is that sliding of the tray relative to the base or high chair may be accomplished quickly.

Another advantage of the invention is that the tray may be removed quickly from the base.

Another advantage of the invention is that the points of operation are disposed at the outer edge of the tray, at a location away from the toddler and close to the parent feeding the child. These points of operation are the control knob for sliding the tray back and forth on the base and the release handle for removing the tray from the base.

Another advantage of the invention is that each of the points of operation are operable with one hand. One hand may be used for sliding the tray to or away from the toddler or for removing the tray from the base while another hand may keep the glass of milk steady in the hand of the toddler.

Another advantage of the invention is that the points of operation are located adjacent to each other.

DESCRIPTION

Figure 1:
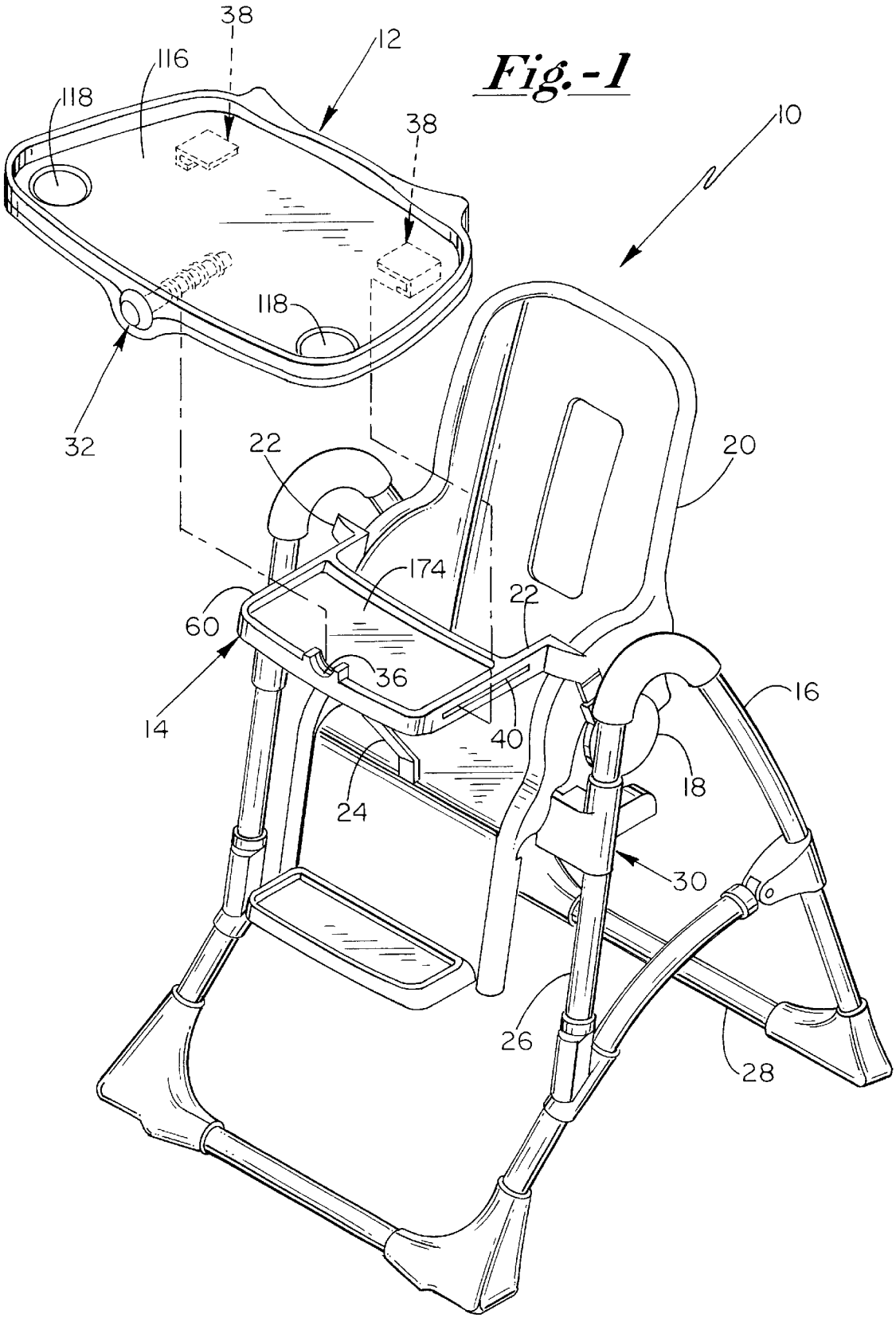
FIG. 1 shows a perspective view of the tray apparatus of the present invention in relation to a high chair, and shows how the tray apparatus includes a tray, a base, a hand operated screw for sliding the tray relative to the base, and an engagement mechanism for locking the tray to the base.

FIG. 1 shows the present tray apparatus 10. The tray apparatus 10 includes a tray 12 and a base 14. The tray 12 is removably connectable to the base 14 and is further slideable relative to the base 14. The base 14 is removably connectable to a high chair 16. The high chair 16 includes pivoting arms 18 that may lock in several positions, such as in an open position where the pivot arms 18 are swung upwardly such that the plane of the base 14 lies in a vertical position so that a small person may be removed from a seat 20 underneath the base 14 (and/or tray 12), such as in a closed position where the plane of the tray 12 lies in a horizontal position for eating, drawing or other use of the tray 12, and such as in intermediate positions between the vertical and horizontal. The pivot arms 18 engage base extensions 22 extending from the base 14. A base support 24 extends between the base 14 and the high chair seat 20.

The high chair seat 20 is slidingly connected to a pair of generally upright legs 26 of a frame 28 via a sliding lock mechanism 30. The sliding lock mechanism 30 permits the high chair seat 20 and thus the high chair tray 12 to be set at multiple heights. Accordingly, after setting the vertical height of the high chair tray 12, the horizontal position of the high chair tray 12 may be moved by sliding the tray 12 relative to the base 14. The sliding lock mechanism 30 may include a structure similar to the structure of the sliding engagement mechanism described herein as between the tray 12 and base 14. In other words, a resilient foot in the mechanism 30 that is biased toward a closed position may bring pressure to bear on the upright leg 30 to incrementally lock the mechanism 30 at any one of a multiple (or infinite) number of positions.

FIG. 1 further shows a hand operated screw 32 on the tray 12 for sliding the tray 12 relative to the base 14. The hand operated screw 32 includes threads 34 for engaging a groove or thread receptor 36 formed in a cradle like portion of the base 14.

FIG. 1 further shows engagement plates 38 on the tray 12 for interacting with the base 14 and for interacting with slots 40 formed in the base 14. The engagement plates 38 and slots 40 lock the tray 12 and base 14 together and, at the same time, permit a sliding of the tray 12 relative to the base 14. The engagement plates 38 further frictionally engage edge portions of the base 14 forming the slots 40 to control sliding of the tray 12 and base 14 relative to each other when the hand operated screw 32 is turned. In other words, when the hand operated screw 32 is turned to slide the tray 12 relative to the base, such a sliding is somewhat opposed by the frictional engagement between the engagement plates 38 and edge portions of the base 14 forming the slots 40.

Figure 2:
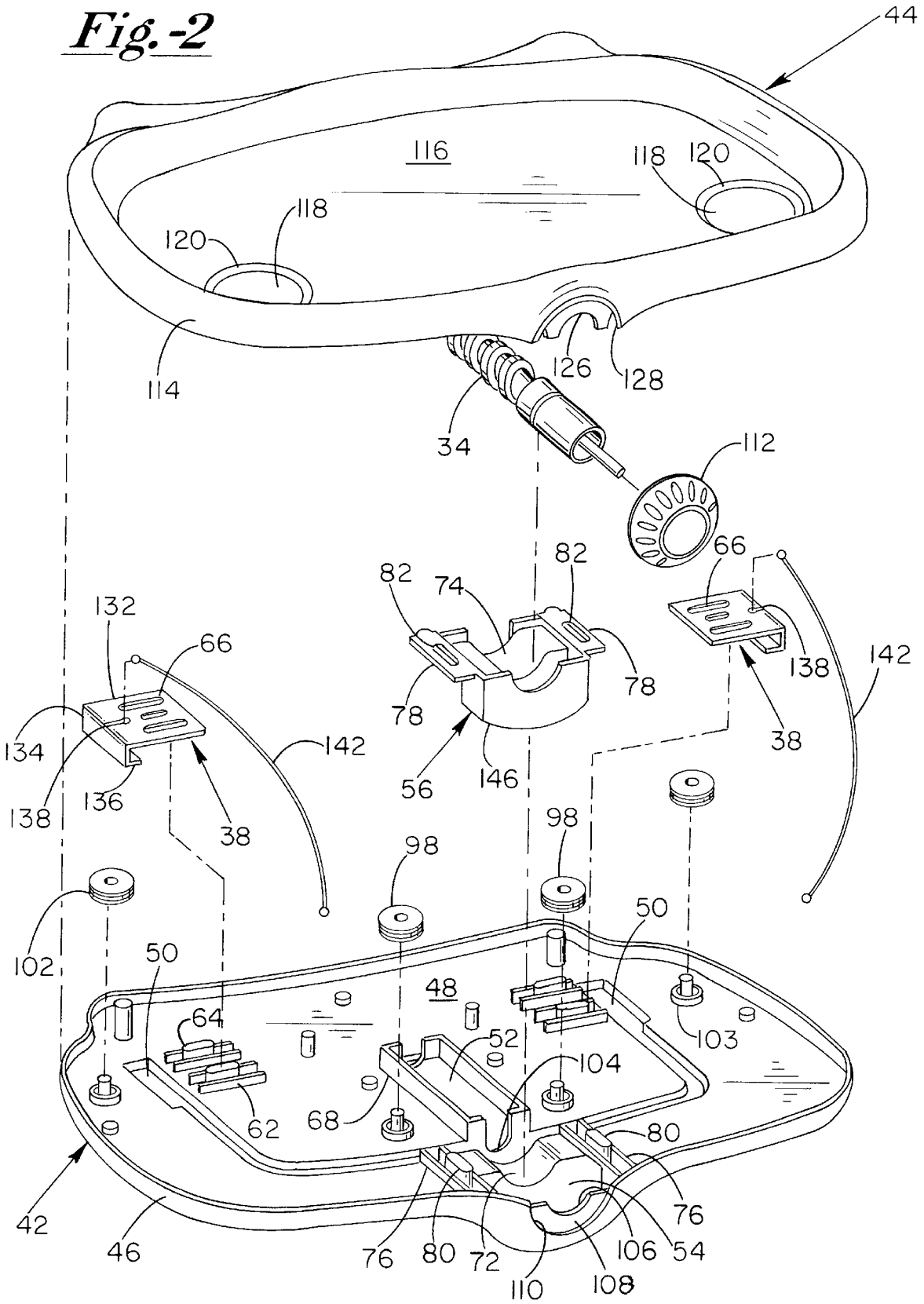
FIG. 2 is an exploded view of the tray of FIG. 1.

FIG. 2 shows that the tray 12 includes a lower half 42 and an upper half 44. Lower half 42 is a molded plastic piece and includes a peripheral rim or ridge 46 for engaging or mating with the tray upper half 44. Lower half 42 further includes a floor 48 about which the ridge 46 runs. Floor 48 includes a pair of openings 50 for the engagement plates, an opening 52 for the threads 34 of the hand operated screw 32, and an opening 54 for a release handle 56. Floor 48 further includes an integral downwardly extending abutment 58. The abutment 58 is generally U-shaped and is tailored to match the shape of the U-shaped upper and outer edge or lip 60 of the base 14, as shown in FIG. 1. Side sections of the U-shaped abutment 58 run into the openings 50 for the engagement plates 38. The side sections of the U-shaped abutment 58 and the side sections of the U-shaped base edge 60 may act like guides when the tray 12 and base 14 slide relative to each other and the base section of the U-shaped abutment 58 and the base section of the U-shaped base edge 60 may act like a stop or abutment that prevents the tray 12 from being slid further toward the seat back of the seat 20 of the high chair 16.

Figure 3:
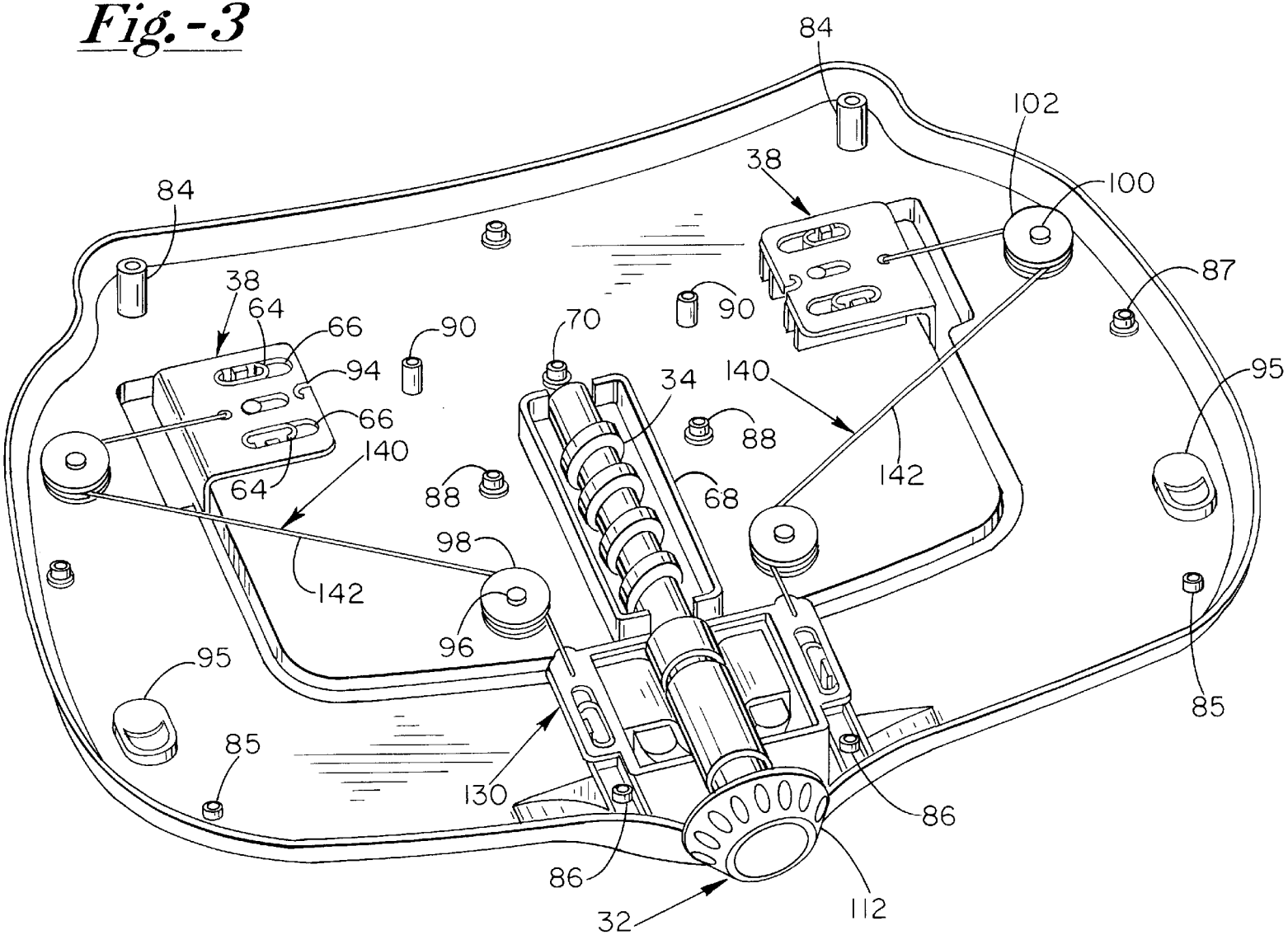
FIG. 3 is a perspective view of the bottom inside half of the tray shown in FIG. 2.
Figure 4:
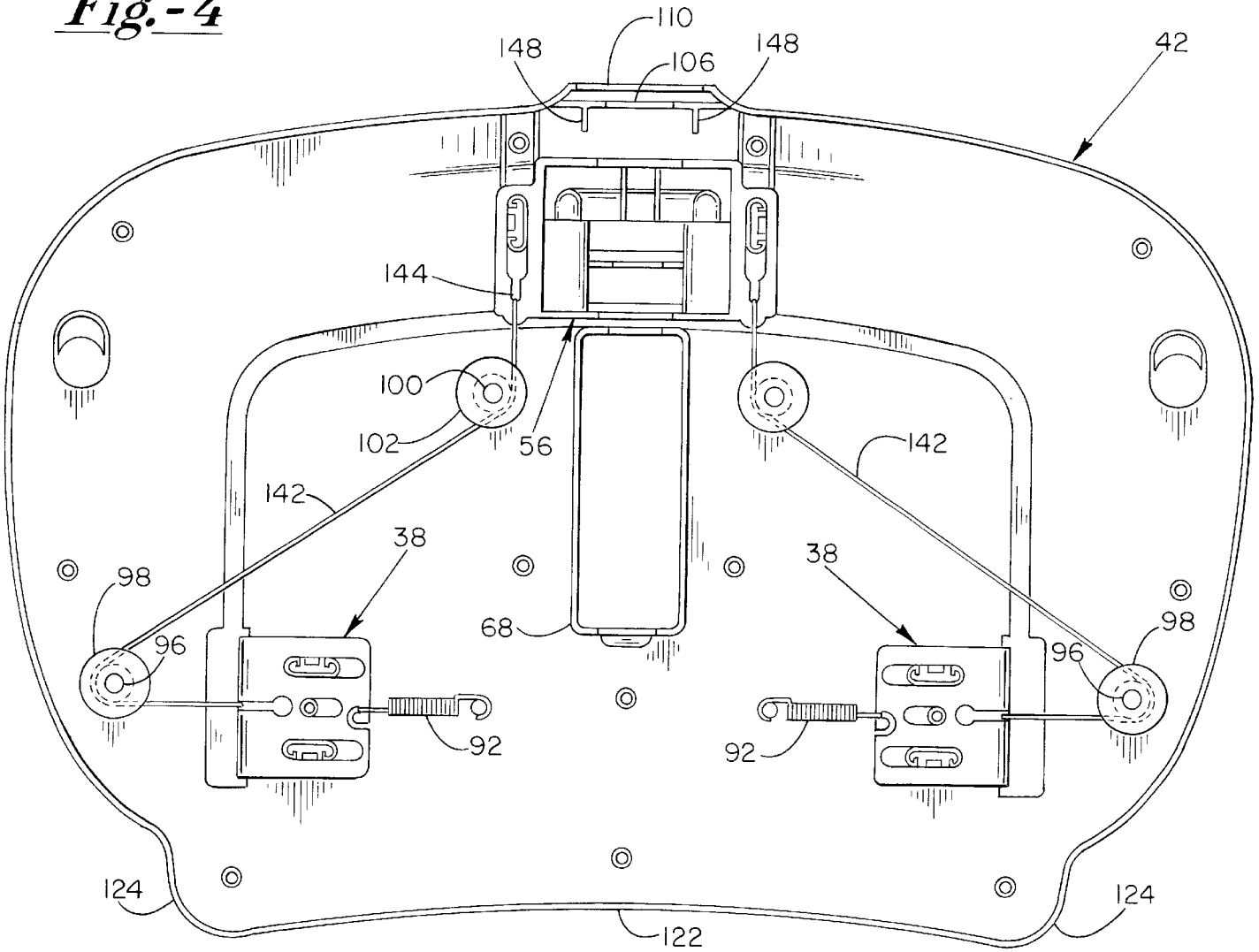
FIG. 4 is top view of the bottom inside half of the tray shown in FIG. 3 with the hand operated screw mechanism removed and shows the engagement mechanism for locking the tray to the base, with the engagement mechanism in an engaged position where the tray is fixed to the base and where the tray is slideable relative to the base.

As shown in FIGS. 2, 3 and 4, floor 48 further includes integral ribs 62 on which the engagement plates 38 slide back and forth. Situated between the ribs 62 is a set of three pegs or guides 64 for cooperating with three slots 66 formed in the engagement plates 38.

As shown in FIGS. 2, 3 and 4, floor 48 further includes a housing 68 for the hand operated screw 32. An upper edge of the housing 68 mates with a portion of the upper half 44 of the tray 12. Opposite ends of the housing 68 include openings for the hand operated screw 32. Adjacent one opening is a peg 70 for preventing axial displacement of the hand operated screw 32 without unduly limiting a free spinning or turning of the hand operated screw 32.

As shown in FIGS. 2, 3 and 4, floor 48 includes a release handle reception portion formed about the release handle opening 54. This reception portion includes an undulating floor portion 72 for cooperating with an undulating portion 74 of the release handle 56. This reception portion further includes integral ribs 76, a pair of which is disposed on each of the sides of the release handle opening 54, on which wings 78 of the release handle 56 ride or slide. This reception portion further includes pegs 80 situated between ribs 76 for cooperating with guides or slots 82 formed in the wings 78 of the release handle 56.

As shown in FIGS. 2, 3 and 4, floor 48 further includes a number of posts for spacing the halves 42 and 44 apart, for locating the halves 42 and 44 relative to each other, and for receiving pin connectors such as screws for tying the halves 42 and 44 together. These posts include a pair of rear corner posts 84, a pair of front corner posts 85, a pair of front medial posts 86, a pair of side posts 87, and a pair of central posts 88. It should be noted that peg 70 also serves as a post for receiving a pin connector. It should be further noted that the centermost peg 62 serves as a post for receiving a pin connector.

As shown in FIGS. 2, 3, 4 and 9, floor 48 further includes a pair of pegs 90. Each of the pegs 90 serves as a base for an end of a coil spring 92. The other end of coil spring 92 is engaged to a receptor 94 formed in the respective engagement plate 38. The pegs or posts 90 may also serve to space the halves 42 and 44 apart from each other.

Figure 5:
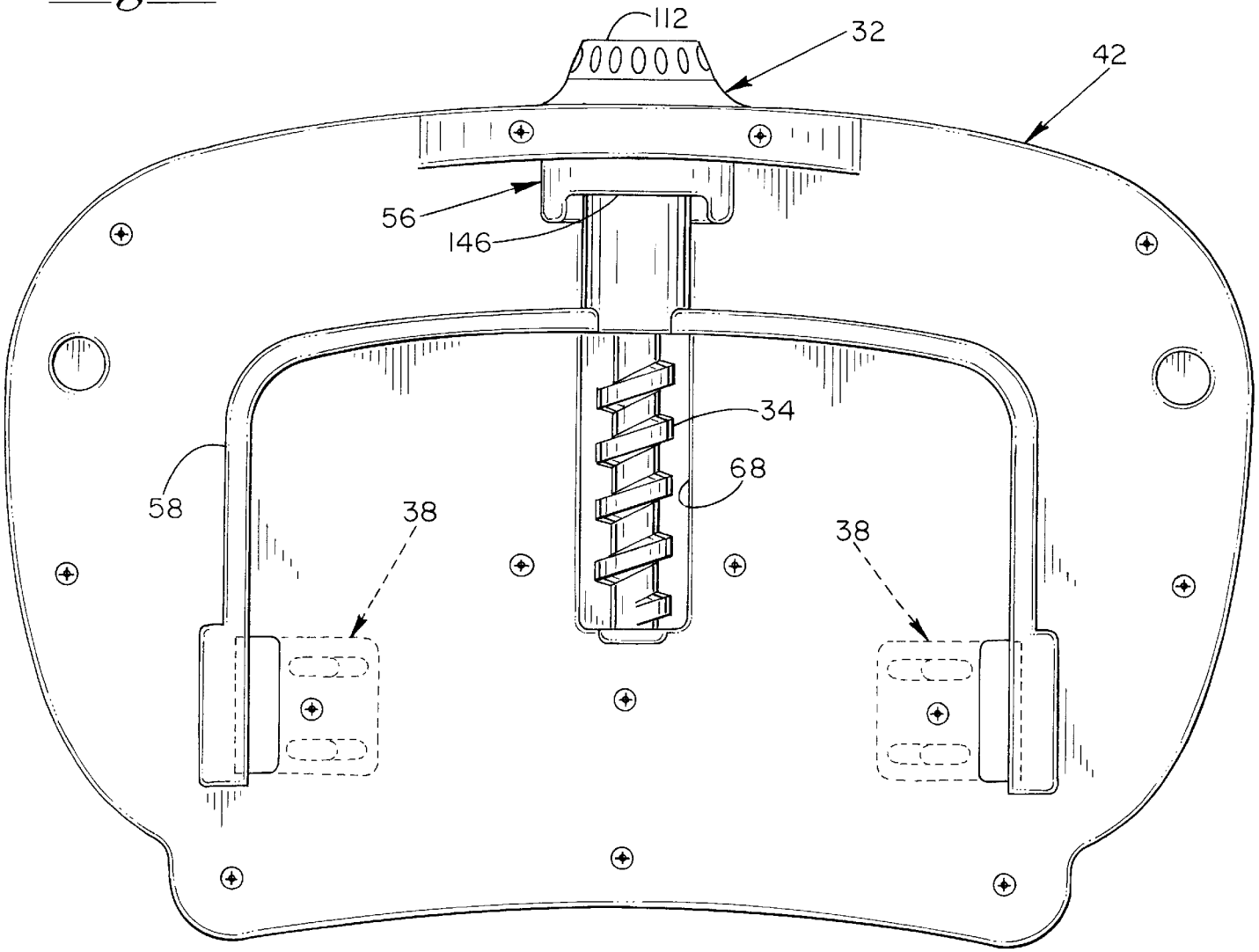
FIG. 5 is a bottom view of the tray shown in FIG. 1.

As shown in FIGS. 2, 3 and 4, floor 48 further includes a pair of female receptors 95 for cooperating with a pair of male connectors fixed on a back side of the high chair 16 such that the either the tray 12 by itself or both the tray 12 and base 14, with the base 14 engaged to the tray 12, may be hung on the back side of the high chair 16. The pair of female receptors 95 are accessible from the underside of the tray 12. The underside of the tray 12 is shown in FIG. 5. It should be noted that the male connectors on which the tray 12 and base 14 are hung may be located on the back of the seat 20 or somewhere on the frame 28.

As shown in FIGS. 2, 3 and 4, floor 48 still further includes a pair of posts 96 for first pulleys 98 and a pair of posts 100 for second pulleys 102. Each of the posts 96 and 100 includes an annular base 103 for spacing the pulleys 100 and 102 from the floor 48. Posts 96 and 100 may further aid in spacing halves 42 and 44 apart from each other.

As shown in FIGS. 2 and 4, lower half 42 further includes receptors for the hand operated screw 32. These receptors includes a first semicircular edge 104 formed in the housing 68 and a second semicircular edge 106 formed in an integral brace 108. Another receptor is third semicircular edge 110 formed in the peripheral lip 46. Third semicircular edge 110 receives an inner circular portion of a knob 112 of the hand operated screw 32.

Figure 6:
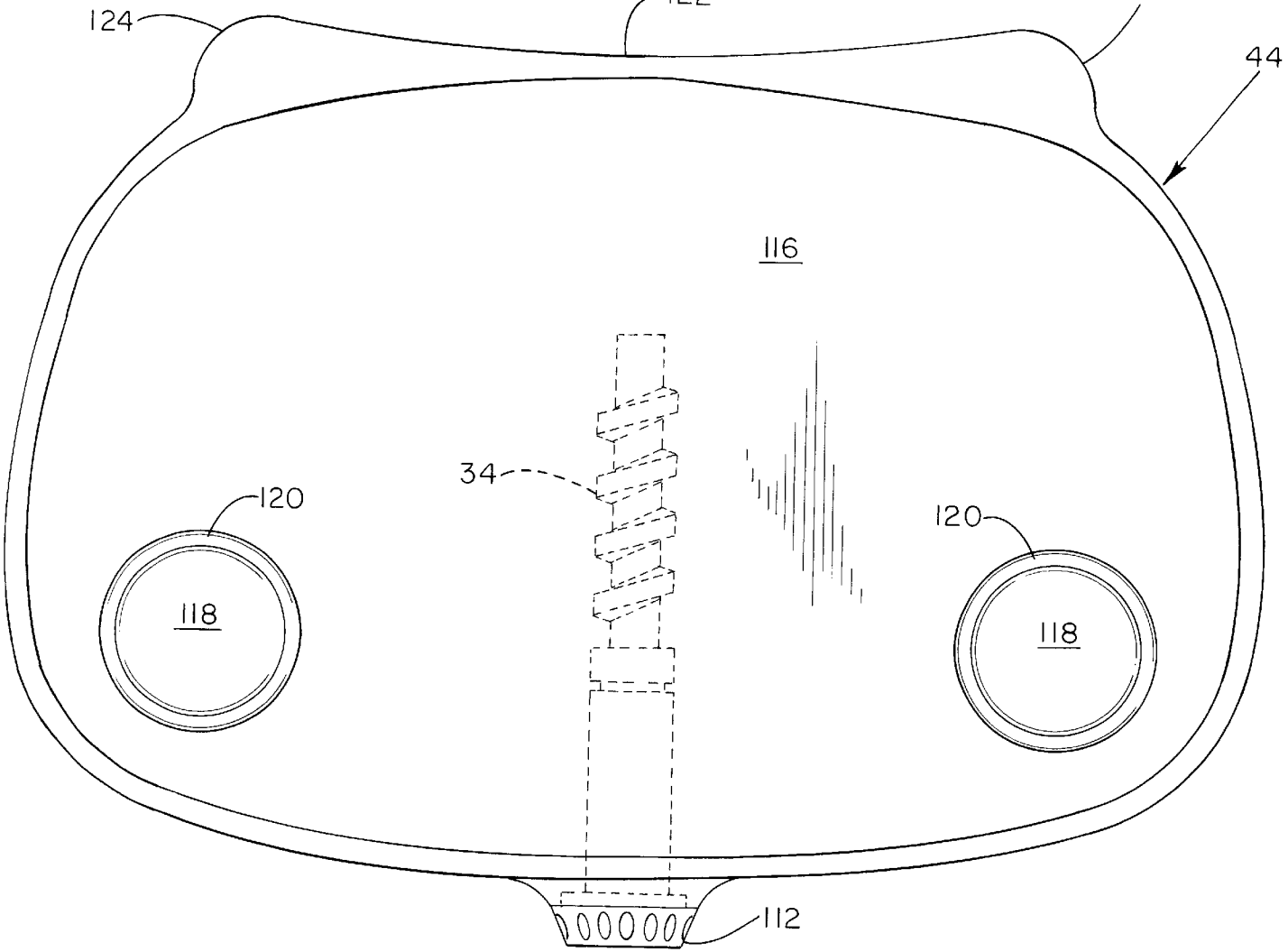
FIG. 6 is a top view of the tray shown in FIG. 1.
Figure 7:
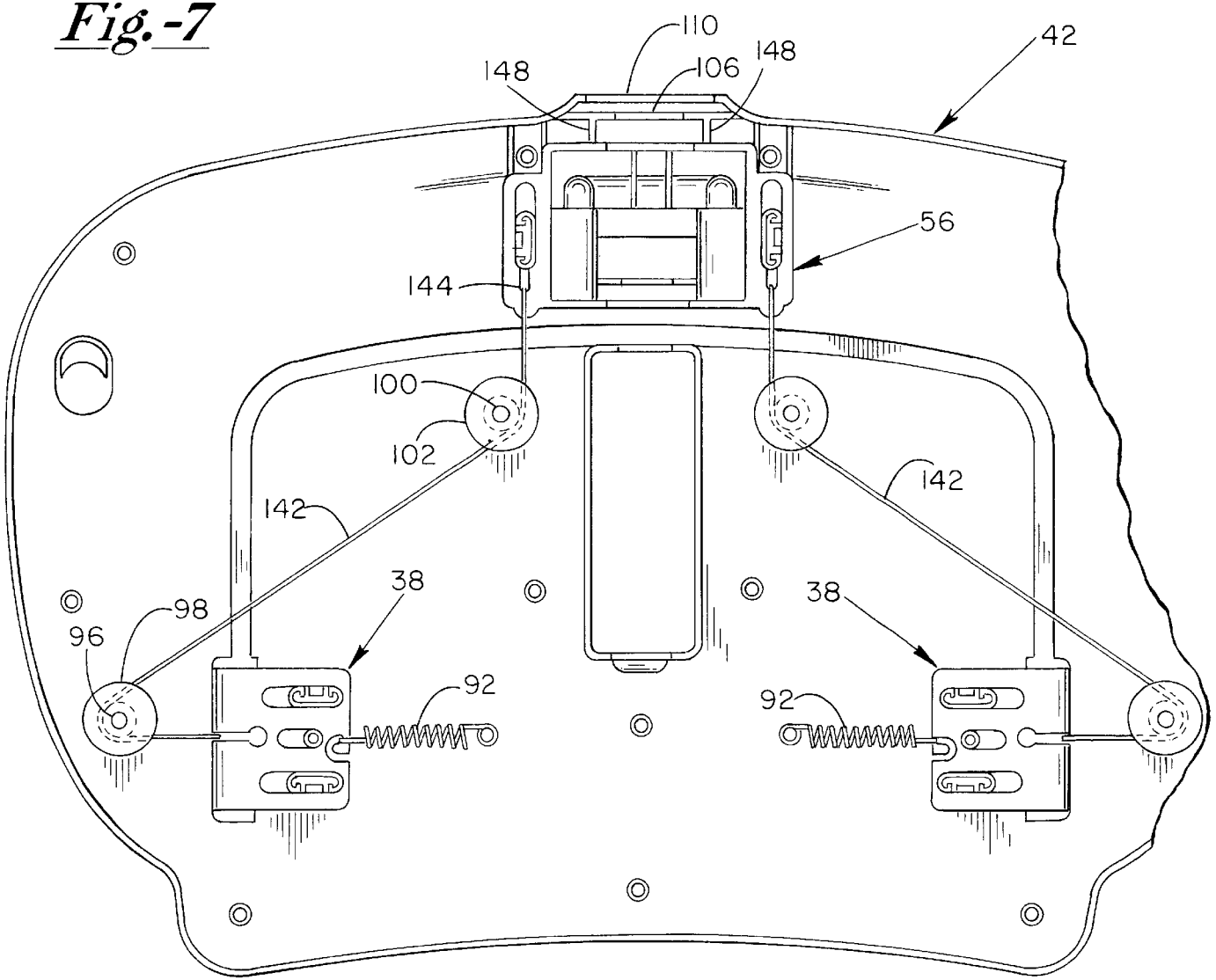
FIG. 7 is a view similar to the view of FIG. 4, except that the engagement mechanism is in a disengaged position where the tray may be removed from the base of FIG. 1.
Figure 8:
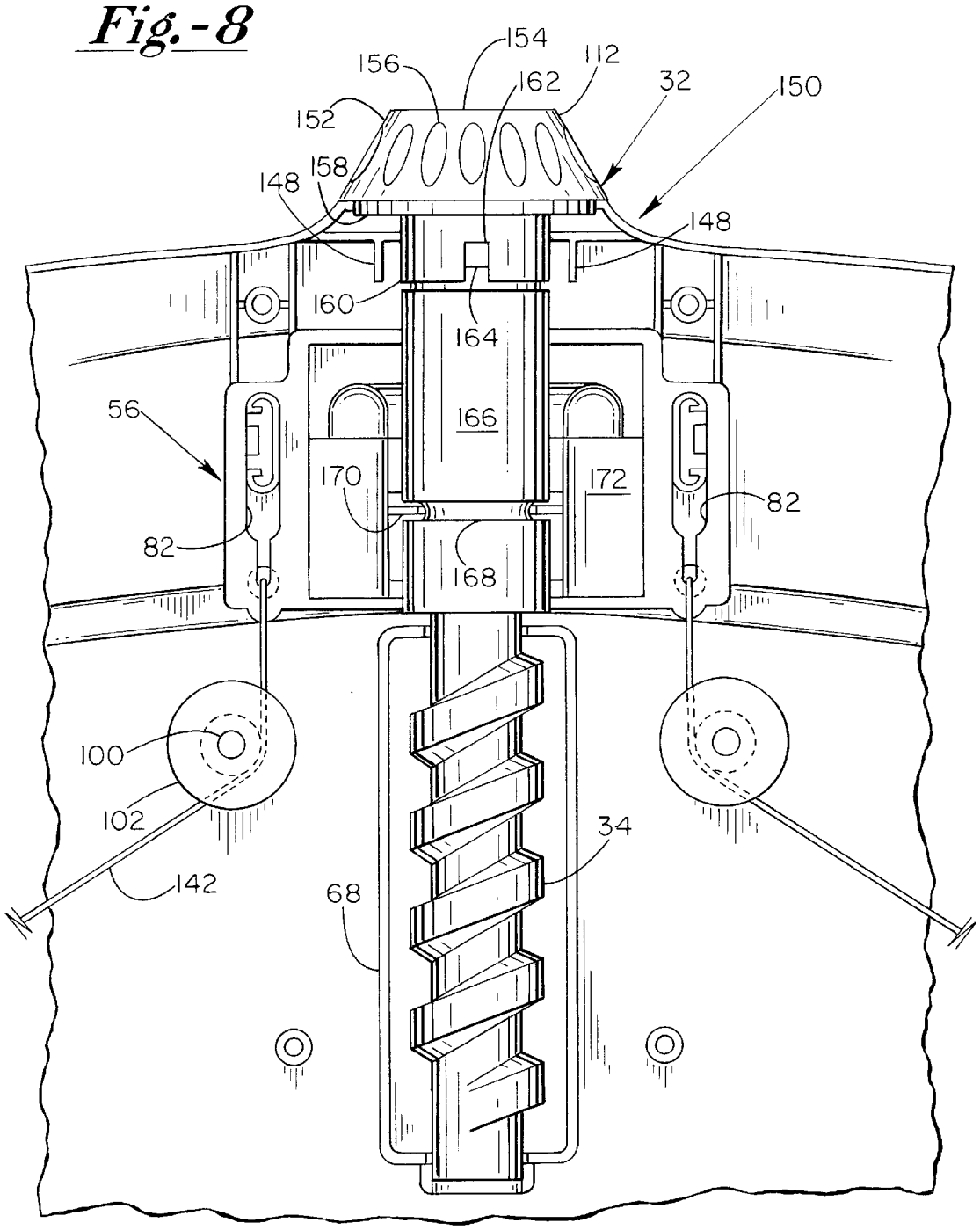
FIG. 8 is a detail view of the release handle and hand operated screw shown in FIG. 2.

As shown in FIGS. 2 and 6, upper half 44 of tray 12 includes a peripheral ridge or lip 114 that engages the peripheral lip 46 of the lower half 42. Upper half 44 further includes an eating surface 116 having a pair of cup or glass holders 118 recessed in the surface 116 via a tapered annular transition 120. Upper half 44 further includes a chest hugging portion or proximal edge 122 having two projecting ends 124 extending away from the eating surface 116 and towards a chest of a small person sitting in the high chair 16. The lip 114 curves between the two projecting ends 124.

As shown in FIG. 2, upper half 44 of tray 12 includes receptors for the hand operated screw 32. These receptors include a first semicircular edge 126 for cooperating with semicircular edge 106 and a second semicircular edge 128 for cooperating with semicircular edge 110.

A quick release mechanism 130 for the tray apparatus 10 includes the engagement plates 38. The engagement plates 38 are generally U-shaped and include an upper plate section 132, a side plate section 134 and a lower plate section 136. Lower plate section 136 slides in slot 40 of base 14 with some friction to oppose a sliding force generated by the hand operated screw 32. Slot 40 has two ends and these ends define the distance of travel of engagement plates 38. Engagement plate 38 further include a cable receptor 138.

Quick release mechanism 130 further includes a pulley mechanism 140. Pulley mechanism 140 includes a cable 142 having one end engaged in the cable receptor 138 of the engagement plate 38 and another end engaged to a cable receptor 144 in a wing 78 of the release handle 56. Cable 142 extends from wing 78 to and about pulley 98 to and about pulley 102 to cable receptor 138 in engagement plate 38. When the cable 142 is pulled via the release handle 56 in a first direction, engagement plate 38 is pulled in a transverse second direction. When engagement plate 38 is so pulled, such a pulling is opposed by coil spring 92. As engagement plate 38 is so pulled, bottom plate section 136 moves transversely or laterally out of slot 40, permitting the tray 12 to be removed from the base 14. To place the tray 12 back on the base, the release handle 56 is pulled to draw engagement plate 38 laterally, the tray 12 is placed on the base 14 to match the threads 34 with receptor 36, and then the release handle 56 is released to permit coil spring 92 to draw engagement plate 38 to its normal closed position where lower plate section 136 resides in slot 40 of base 14.

As indicated above, quick release mechanism 130 and pulley mechanism 140 are operated by release handle 56. Release handle 56 includes a finger grip portion 146 which extends through opening 54 and this finger grip portion can be seen in FIGS. 2 and 5. Release handle 56 is supported on and slides on lower half portion 42 via wings 78 and further via portion 74 which rests and slides on undulating floor portion 72. Release handle 56 slides longitudinally between stops 148, shown in FIG. 4, and an end of housing 68. When quick release mechanism 130 is closed such that engagement plate 38 engages slot 40 in base 14, release handle 56 abuts hand operated screw housing 68 and is biased toward such a position by coil spring 92.

An incremental slide generating mechanism 150 includes the hand operated screw 32 having the threads 34 and further includes the thread receptor 36 formed in the base 14. Hand operated screw 32 includes the knob 112. Knob 112 includes a tapering surface 152 and a face 154. Tapering surface 152 includes dimples or recesses 156 to minimize slippage of the fingers when turning the knob 112. Knob 112 further includes an interior annular surface 158 for engaging semicircular edge receptor 128 of the upper half 44 and semicircular edge receptor 110 of the lower half 42 of the tray 12. Knob 112 further includes a cylindrical receptor portion 160 having a slot 162 for receiving a key 164 of a shaft 166. Shaft 166 includes an annular groove 168 which interacts with a semicircular annular rib 170 extending from a snap in floor piece 172. A cooperating semicircular annular rib extends downwardly from upper half 44 to engage annular groove 168 to prevent hand operated screw 32 from moving in the axial (or longitudinal) direction. Shaft 166 further includes threads 34.

Base 14 includes lip 60. Lip 60 runs about the periphery of an eating surface 174 such that the base 14 may serve as a substitute tray when main tray 12 is not available, such as when main tray 12 is being cleaned.

In operation, a child may be placed in the seat 20 of the high chair 16 without the base 14 and tray 12 being engaged to the high chair 16. Then, the tray apparatus 10, including the tray 12 and base 14 engaged together, is removed from storage on the back of the high chair 16, such as from the back of the seat 20 of the high chair 16. Then, the base extensions 22 are engaged with the pivoting arms 18 and the base support 24 confronts a portion of the underside of the tray 12, such as the outside surface of undulating portion 72, to support the base 14 and tray 12 along with the pivoting arms 18. It should be noted that base support 24 is not required to support the base 14 and tray 12.

If desired, the tray 12 and base 14 may be connected to the pivoting arms 18 prior to placing the child in the seat 20 of the high chair 16. In this case, the tray 12 and base 14 may be pivoted upwardly, whereupon the child may climb into the seat 20 underneath the tray 12 and base 14. Then the tray 12 and base 14 are pivoted downwardly and, if desired, base support 24 is engaged between the seat 20 and the base 14.

Then, for adjustment of the tray 12 relative to the parent or caregiver, the sliding lock mechanism 30 is operated to draw the seat 20, and thus the tray 12, to the desired height.

Then, for adjustment of the tray 12 relative to the child or seat 20, the knob 112 is turned to operate the hand operated screw 30. This turns the threads 34 that engage the thread receptor or slot 36 in the base 14. The tray 12 thus slides on the base 14 to and from child or seat 20. Turning the knob 112 clockwise incrementally slides the tray 12 in towards the child or seat 20. Turning the knob 112 counterclockwise incrementally draws the tray 12 away from the child or seat 20. Opposing such turning of the threads 34 in the thread receptor or slot 36 are the friction generating engagement plates 38. Specifically, lower plate sections 136 fit snugly in slots 40 to provide resistance to the hand operated screw 30. Base 14 is formed of sufficiently hard durable plastic to provide such resistance over time.

The range of motion for the sliding of the tray 12 on the base 14 is preferably limited by the ends of the slot 40. That is, when an end of each of the lower plate sections 136 engages a respective end of each of the slots 40, the sliding is halted. However, if desired, the range of motion may be limited by the axial length of the threads 34. Further, if desired, the range of motion when sliding the tray 12 toward the child or seat 20 may be halted when the U-shaped abutment 58 of the tray 12 hits the lip 60 on the base 14.

Within the range of motion of the tray 12 relative to the base, or when the tray 12 comes to rest at either of the limits of the range of motion, it should be noted that the tray 12 is stable relative to the base 14. That is, without turning the knob 112, the tray 12 is stationary relative to the base 14 and does not slide on its own either toward the child or seat 20 or away from the child or seat 20. This stationary engagement is provided by the relatively tight fit of the hand operated screw 30 in the tray 12 such that rotation of the screw 30 does not occur from, for example, the strength provided by a child pushing against edge or chest hugging portion 122. This stationary engagement is further provided by the friction fit between lower plate portions 136 and slots 40. This friction fit is provided by upper and lower surfaces forming slot 40 effectively pinching or machined at a distance from each other that is slightly smaller than the width of lower plate portion 136.

The power to move the tray 12 out of the stationary engagement and into a sliding engagement is provided by the relatively large knob 112. The greater the circumference of the knob 112, or the greater the radius of the circle defined by the dimples 156, the more power that is provided to the threads 34, when the circumference of the knob 112 or dimples 156 are manipulated by the fingers.

To take the tray 12 off the base 14, the quick release mechanism 130 is operated by putting the palm of one's hand such as on the knob 112 and gripping the finger grip portion 146 of release handle 56 with one or more fingers. The hand is then squeezed to draw in the finger grip portion 146, to pull the cables 142, to stretch the coil springs 92, and to draw the lower plate portions 136 out of the slots 40. The tray 12 is then lifted off the base 14. The release handle 56 is released and the coil springs 92 draw in the engagement plates 38 to a rest position against pegs 64.

Figure 9:
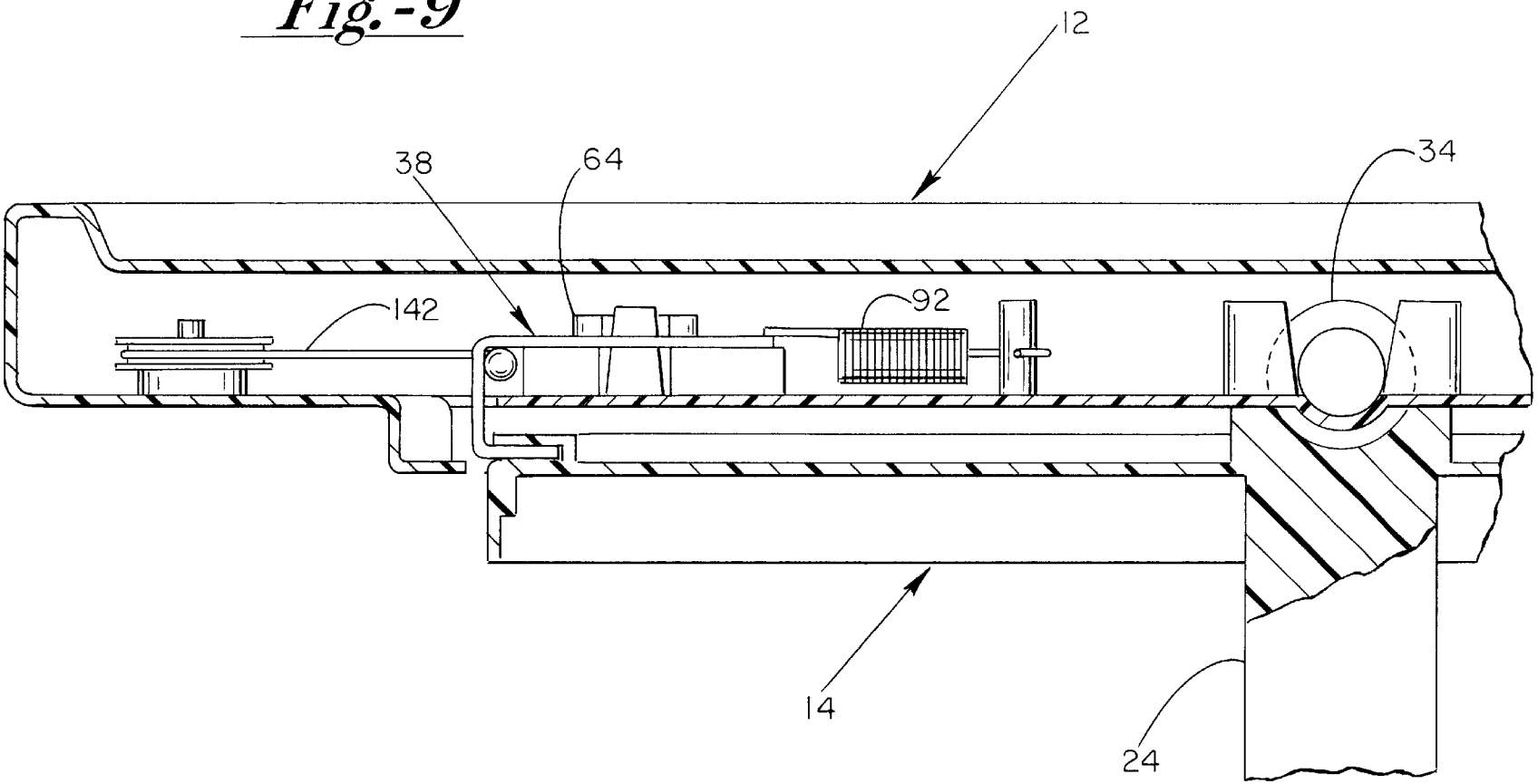
FIG. 9 is a section view of the tray and base of FIG. 1 and shows the engagement mechanism engaged such that the tray and base are engaged and shows the hand operated screw cooperating with a thread receptor formed in the base.

To place the tray 12 back onto the base 14, the quick release mechanism 130 is operated by putting the palm of one's hand such as on the knob 112 and gripping the finger grip portion 146 of release handle 56 with one or more fingers. The hand is then squeezed to draw in the finger grip portion 146, to pull the cables 142, to stretch the coil springs 92, and to draw the lower plate portions 136 outwardly. The tray 12 is then placed on the base 14, aligning the threads 34 with the thread receptor or slot 36. The release handle 56 is released and the coil springs 92 draw in the engagement plates 38 such that lower plate sections 136 slip into slots 40. It should be noted, as can be seen in FIG. 9, that the elongate innermost edge of lower plate sections 136 do not engage the innermost edge of slots 40 but rather are spaced slightly therefrom. This is because the inward sliding of the engagement plates 38, provided by the coil springs 92, is halted by pegs or stops 64.

It should be noted that the engagement plates 38 and their cooperating slots 40 are, as a whole, a guide for the sliding of the tray 12 on the base 14. Engagement plate 38 is one guide portion and slot 40 is another guide portion. Accordingly, engagement plates 38 and slots 40 play a part in the incremental slide mechanism 150 as well as a part in the quick release mechanism 130.

It should further be noted that the tray apparatus 10 is easy to fix. The tray halves 42 and 44 may be easily taken apart with a Phillips screwdriver. The cables 142 may be easily replaced via the cooperation between the ball like ends of the cables 142 and the key like receptors 138 in the engagement plates 38 and the key like receptors 144 in the release handle 56. The pulleys 98 may be replaced.

It should further be noted that, if desired, the hand operated screw 30 may be housed in the base 14 instead of the tray 12. In this case the thread receptor 36 may be formed in the tray 12.

It should further be noted that, if desired, the thread receptor or slot 36 and the slots 40 may be part of the seat 20 or part of the frame 28 of the high chair 16. In this case, the base 14 may not be required. However, in such a case, it is noted that the high chair 16 (or seat 20 or frame 28) forms the base for the tray 12.

It should be noted that the tray 12 as a whole generally defines a plane and that the base as a whole generally defines a plane. When the tray 12 and base 14 slide relative to each other, the planes of the tray 12 and base 14 slide relative to each other.

It should further be noted that knob 112 is on the distal edge of the tray 12 that is opposite of the proximal edge or chest hugging portion 122. The knob 112 is thus conveniently located near the caregiver at a front of the tray apparatus 10.

It should further be noted that the engagement plates 38 slide in the slots 40 in a first direction and that the engagement plates 38 are drawn out of the slots 40 by the coil springs 92 in a second direction, and that the first and second directions are transverse of the other.

It should further be noted that the quick release handle 56 is located at a front middle portion of the tray for convenience for the caregiver. In other words, the quick release mechanism 130 is controlled from a first location via the release handle 56 while effectively operating at a second location, i.e., where the engagement plates 38 meet the slots 40. The pulley mechanism 140 operates between the first and second locations. It can be further noted that the release handle 56 is operated by a pulling in a first direction and that the engagement plates are operated by a pulling in a second direction, wherein the first and second directions are transverse to each other, and that the difference in the directions is accounted for by the pulley mechanism 140.

It should be further noted that the quick release mechanism 130 is effectively a locking mechanism because the biased coil springs 92 keep the engagement plates normally locked into the slots 40.

As to the high chair 16, and specifically as to the sliding lock mechanism 30, pivoting arms 18, and base support 24, the following U.S. Patent is hereby incorporated by reference in its entirety: U.S. Pat. No. 6,126,236 issued Oct. 3, 2000 to Sung-Tsun Wu.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A tray apparatus for a high chair, comprising:

a) a base to be attached to the high chair;

b) a tray;

c) a quick release mechanism between the base and the tray such that the tray is quickly engageable to and quickly removable from the base, wherein the quick release mechanism permits a sliding of the base relative to the tray; and d) an incremental slide generating mechanism between the base and the tray to generate relative sliding of the base and tray such that the tray and base are incrementally slideable relative to each other, wherein the incremental slide generating mechanism comprises a hand operated screw on one of the base and tray and a screw thread receptor on the other of the base and tray, wherein the hand operated screw includes threads for engaging the thread receptor such that, when the hand operated screw is turned, the threads engage the screw thread receptor and the base and tray slide relative to each other whereby the tray is incrementally slideable relative to the base when the hand operated screw is turned and such that a turning of the hand operated screw slides the tray relative to the base.

2. The tray apparatus according to claim 1, wherein the quick release mechanism comprises a first member on the base and a second member on the tray, with the first and second members being resiliently drawable to and away from each other, with the first and second members being biased toward each other whereby the quick release mechanism is normally closed such that the tray and base are normally in an engaged position.

3. A tray apparatus for a high chair, comprising:

a) a base to be attached to the high chair;

b) a tray, wherein the tray is engaged to the base such that the tray is slideable relative to the base while the tray is engaged on the base;

c) a hand operated screw on one of the base and tray and a screw thread receptor on the other of the base and tray, wherein the hand operated screw includes threads for engaging the thread receptor such that, when the hand operated screw is turned, the threads engage the screw thread receptor and the base and tray slide relative to each other whereby the tray is slideable to a multiple number of positions relative to the base when the hand operated screw is turned and such that a turning of the hand operated screw slides the tray relative to the base; and d) wherein the tray includes a proximal edge and a distal edge, wherein the proximal edge and distal edge are opposite each other, wherein the proximal edge is closer to the high chair and closer to a small person sitting in the high chair, and wherein the hand operated screw extends from the distal edge and includes a hand operated screw head for turning the hand operated screw whereby a caregiver may conveniently adjust the tray apparatus from a front of the apparatus.

4. The tray apparatus according to claim 3, wherein the hand operated screw is on the tray and wherein the screw thread receptor is on the base.

5. The tray apparatus according to claim 3, wherein the base generally defines a first plane and wherein the tray generally defines a second plane, and wherein surfaces of the planes confront and slide over each other when the hand operated screw is turned to slide the tray relative to the base.

6. The tray apparatus according to claim 3, wherein each of the base and the tray includes a guide portion, wherein the guide portions interact with each other in a sliding engagement when the hand operated screw is turned.

7. A tray apparatus for a high chair, comprising:

a) a base to be attached to the high chair;

b) a tray, wherein the tray is engaged to the base such that the tray is slideable relative to the base while the tray is engaged on the base;

c) a hand operated screw on one of the base and tray and a screw thread receptor on the other of the base and tray, wherein the hand operated screw includes threads for engaging the thread receptor such that, when the hand operated screw is turned, the threads engage the screw thread receptor and the base and tray slide relative to each other whereby the tray is slideable to a multiple number of positions relative to the base when the hand operated screw is turned and such that a turning of the hand operated screw slides the tray relative to the base; and d) wherein each of the base and the tray includes a guide portion, wherein the guide portions interact with each other in a sliding engagement in a first direction when the hand operated screw is turned, wherein one of the guide portions is resiliently drawable to and away from the other of the guide portions in a second direction, and wherein the first and second directions are transverse of each other such that the guide portions are disengaged from each other when the guide portions are resiliently drawn apart whereby the tray may be disengaged from the base.

8. The tray apparatus according to claim 3, wherein each of the base and the tray includes a guide portion, wherein the guide portions interact with each other in a sliding engagement, and wherein the guide portions frictionally interact with each other to frictionally control a sliding of the base and tray relative to each other.

9. A tray apparatus for a high chair, comprising:

a) a base to be attached to the high chair;

b) a tray, wherein the tray is engaged to the base such that the tray is slideable relative to the base while the tray is engaged on the base, wherein the tray includes a proximal edge and a distal edge, wherein the proximal edge and distal edge are opposite each other, and wherein the proximal edge is closer to the high chair and closer to a small person sitting in the high chair;

c) an incremental slide generating mechanism between the base and the tray to slide one of the base and tray relative to the other of the base and tray;

d) a rotating hand operated knob on one of the base and tray for controlling the incremental slide generating mechanism such that, when the rotating hand operated knob is turned by hand, the base and tray slide relative to each other; and e) wherein the rotating hand operated knob is disposed on a portion of the distal edge of the tray such that rotating hand operated knob is accessible from a front of the tray apparatus.

10. The tray apparatus according to claim 9, wherein the rotating hand operated knob is disposed on a middle portion of the distal edge of the tray such that the rotating hand operated knob is accessible from a front of the tray apparatus.

11. The tray apparatus according to claim 9, wherein a direction from the proximal edge to the distal edge defines a first direction, and wherein the base and tray slide in the first direction when the rotating hand operated knob is turned such that the tray slides to and away from a small person sitting in the high chair.

12. A tray apparatus for a high chair, comprising:

a) a base to be attached to the high chair;

b) a tray;

c) a release handle operated by hand, wherein the release mechanism is operated by a pulling in a first direction;

d) a quick release mechanism between the base and the tray such that the tray is quickly engageable to and quickly removable from the base, wherein the quick release mechanism is operated by a pulling in a second direction; and e) a pulley mechanism engaged between the release handle and the quick release mechanism such that the release handle is positioned at a first location and the quick release mechanism is positioned at a second location.

13. The tray apparatus according to claim 12, wherein the quick release mechanism comprises a first member on the base and a second member on the tray, with the first and second members being resiliently drawable to and away from each other, with the first and second members being biased toward each other whereby the quick release mechanism is normally closed such that the tray and base are normally locked together.

14. The tray apparatus according to claim 12, wherein the first direction of pulling by the release handle is transverse of the second direction of pulling by the quick release mechanism.

15. A tray apparatus for a high chair, comprising:

a) a base to be attached to the high chair, b) a first tray engageable to and disengageable from the base, wherein the first tray includes a first eating surface and a lip about the first eating surface;

c) wherein the base includes a second eating surface and a lip about the second eating surface such that the base may be used as a second tray when the first tray is not engaged to the base; and d) wherein a hand operated screw extends between the first eating surface of the first tray and the second eating surface of the base, wherein the hand operated screw engages the first tray to the base, and wherein a turning of the hand operated screw slides the first tray relative to the base.

16. The tray apparatus according to claim 15, wherein the base and first tray are incrementally slideable relative to each other when the first tray and base are engaged to each other.

* * * * *